United States Patent [19]

Gallagher

[11] 4,172,302

[45] Oct. 30, 1979

[54] CONTINUOUS LAUNDERING METHOD

[76] Inventor: Paul H. Gallagher, 105 W. Adams St., Chicago, Ill. 60603

[21] Appl. No.: 907,832

[22] Filed: May 19, 1978

Related U.S. Application Data

[62] Division of Ser. No. 729,384, Oct. 4, 1976, Pat. No. 4,091,645.

[51] Int. Cl.[2] ..... D06F 35/00

[52] U.S. Cl. ..... 8/150; 8/159

[58] Field of Search ..... 8/147, 150, 159; 68/43, 68/52, 53, 55, 28, 94, 112, 115, 116, 120, 121, 129, 135, 138, 147, 157, 158, 175, 199, 212, 148, 27, 33, 136, 137, 213, 235 R, 9, 235 D, 10

[56] References Cited

U.S. PATENT DOCUMENTS

| | | | |
|---|---|---|---|
| 430,321 | 6/1890 | Sargent | 68/158 X |
| 671,382 | 4/1901 | Kellogg | 68/137 X |
| 1,360,464 | 11/1920 | Stults | 68/9 |
| 2,923,949 | 2/1960 | Platt | 68/235 D X |
| 3,693,382 | 9/1972 | Grantham | 68/158 X |

*Primary Examiner*—Philip R. Coe
*Attorney, Agent, or Firm*—Paul H. Gallagher

[57] ABSTRACT

A laundering machine for such laundering operations as washing and rinsing, having a tank with an inlet end and an outlet end, the goods being introduced into the apparatus and removed therefrom at the respective ends by suitable means such as conveyors. The apparatus includes two sets of grippers, alternately gripping the goods and positively moving them along in the tank. While each set grips and moves the goods along, the other set releases and gets a new grip, producing a continuous moving action. The grippers produce an agitating action on the goods, and they are adjustable as to the extent of movement toward and from each other in their gripping action, and in the extent of movement of the goods through the tank. Consequently, the grippers are adjustable as to speed of agitating action independently of the speed of movement of the goods through the tank.

8 Claims, 7 Drawing Figures

CONTINUOUS LAUNDERING METHOD

This application is a division of my co-pending application, Ser. No. 729,384, filed Oct. 4, 1976, now U.S. Pat. No. 4,091,645, issued May 30, 1978.

OBJECTS OF THE INVENTION

A broad object of the invention is to provide apparatus particularly adaptable to use in industrial laundering which includes a novel means and method for positively gripping the goods and moving them through the apparatus.

Another object is to provide apparatus and method of the foregoing general character which, in the action of gripping the goods and moving them through the apparatus, also produces an unusually effective agitating action for performing the laundering operations, such as washing and rinsing.

Still another object is to provide apparatus and method of the foregoing general character in which the agitating action is unusually effective for the reason that grippers operate on the goods on mutually opposite sides thereof, and in interacting fashion, produce the agitating action.

A more specific object is to provide apparatus of the foregoing general character in which the grippers include two main groups, working in respectively opposite directions so that while one set is released and moving to a new gripping position, the other set is moving the goods through the apparatus.

Another and broad object is to provide apparatus of the foregoing general character which, because of the novel arrangement for adjustment of the various grippers as to extent of movement and to timing of movement, is particularly effective for accommodating goods of a wide variety of character, such as those difficult to wash and those more easy to wash, which may involve greater agitation in one case than in another, independently of the time element required of a washing operation, both of which can be readily accommodated by the present apparatus.

Still another object is to provide apparatus and method of the foregoing character operative for accommodating goods of substantially any size and shape, even with all different sizes and shapes being washed at random, or in mixed condition.

Still another and broad object of the invention is to provide apparatus and method of the foregoing general character, which because of the novel arrangement for adjustability provided, goods can be given a greater or lesser amount of washing or rinsing action per unit time, as desired, according to the condition of the goods being laundered, whereby successive units of such apparatus may be used in a continuous chain and individually adjusted according to respective laundering conditions desired in each unit, without requiring adjustment in any of the other units in the chain.

DESCRIPTION OF A PREFERRED EMBODIMENT

In the drawings:

FIG. 4 is a view oriented as a plan view of FIG. 1, but showing only the driving and driven components;

Figure 1:
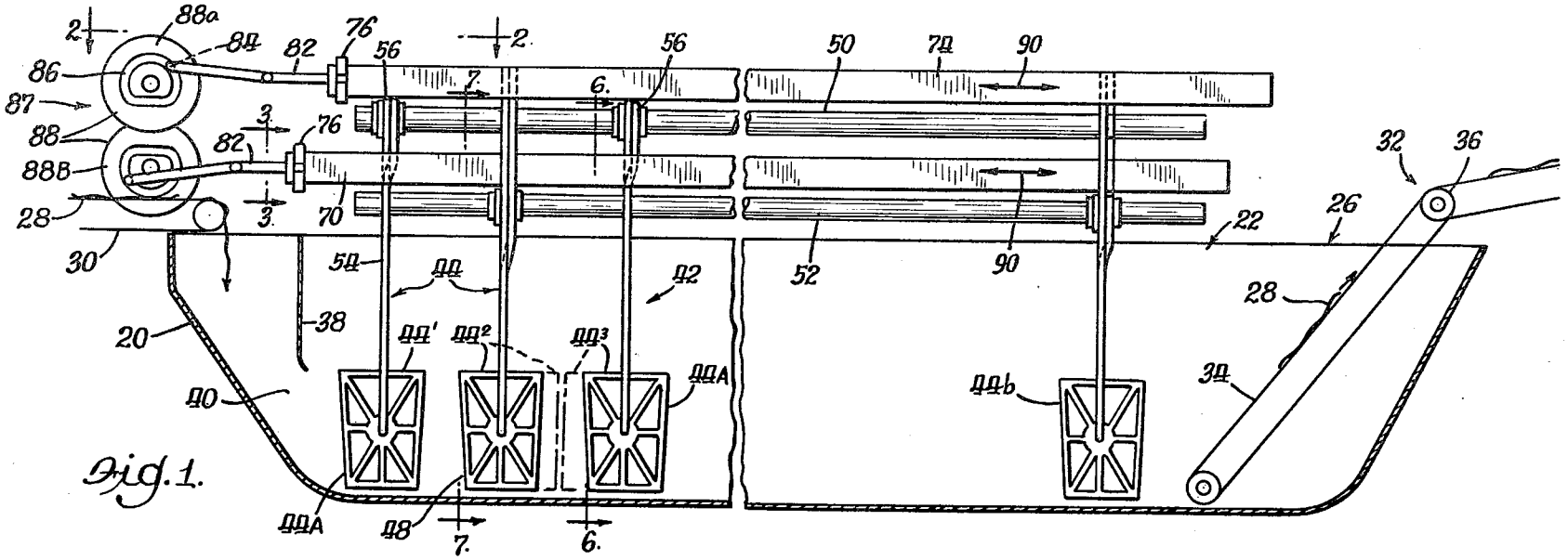
FIG. 1 is a side elevational view of the apparatus of the invention partially diagrammatic in character.

Referring in detail to the accompany drawings, attention is directed first to FIG. 1 which shows a tank 20 which may have an open top indicated at 22, an inlet end 24 and an outlet end 26. The goods to be laundered may be any of a wide variety and as an example they may be towels 28. They are introduced into the tank at the inlet end by suitable means such as a conveyor 30 and are withdrawn at the exit end also by suitable means such as a conveyor 32. The conveyors 30, 32 may be of any presently known kinds, the conveyor 30 merely dropping the towels into the tank, while the conveyor 32 preferably has an inclined section 34 directly receiving the towels in the tank and a posterior section 36 carrying the goods from the section 34. The tank 20 at its inlet end may be provided with a transverse plate 38 forming an opening 40 adjacent the bottom defining a restricted passage for the towels, for use in conjunction with the gripper means as described hereinbelow.

The means for positively moving the goods through the tank is indicated in its entirety at 42 and includes a plurality of grippers or gripper members 44. These grippers are arranged in pairs individually identified $44^1$, $44^2$, $44^3$, etc., those of each pair gripping the goods therebetween. The grippers are also arranged in two groups, 44A and 44B, those of the two groups being alternately arranged, and each group including several pairs, the particular number of pairs depending upon the character of the goods, the desired degree of washing action, etc.

Broadly stated, one group of grippers, e.g., 44A, grip the goods and move them along in the tank while the other group, 44B, release the goods and move in retracting direction where they again grip the goods and then move them along in the tank while the first group release them and move in retracting direction to again grip them, etc., alternately, oppositely gripping and releasing, to progressively move the goods along in the tank. For convenience the goods will be considered as moving "forwardly" in progressing through the tank, from the inlet end to the outlet end.

Each gripper 44 includes a gripper plate 48 generally of open work construction, having openings of substantial total area, but the particular shape thereof is secondary, this construction being referred to again hereinbelow.

Figure 6:
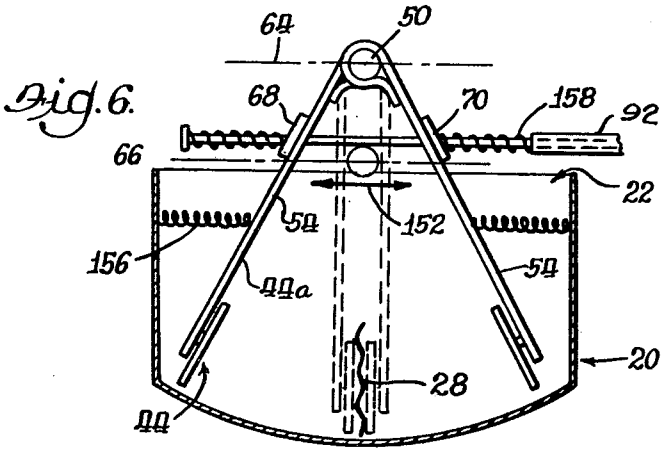
FIG. 6 is a sectional view taken at line 6—6 of FIG. 1.
Figure 1:
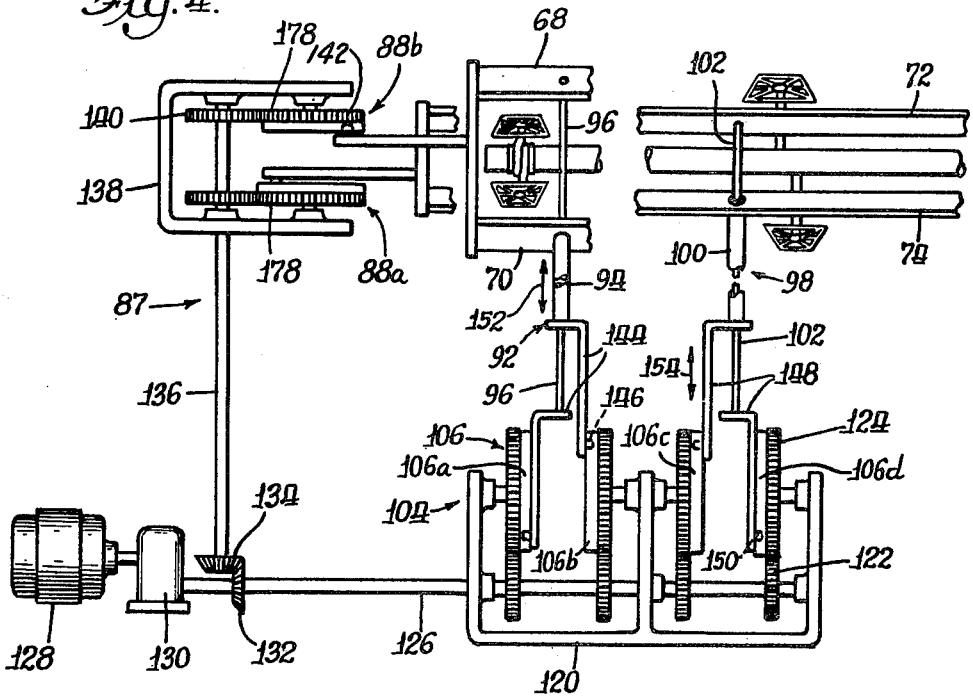

Incorporated in the mechanism 42 are an upper shaft 50 and a lower shaft 52 above the tank and extending longitudinally therealong. The grippers are mounted for swinging movement toward and from each other on the shafts about the axes of the latter. In the group of grippers 44A, each gripper plate 48 is mounted on an arm 54, the two arms of each pair being mounted on the shaft 50 as mentioned, in a bearing assembly 56 of known kind, enabling the gripper members to swing freely about the axis of the shaft, with their lower ends moving toward and from each other, this movement being indicated by the solid and dotted line positions in FIG. 6.

Figure 7:
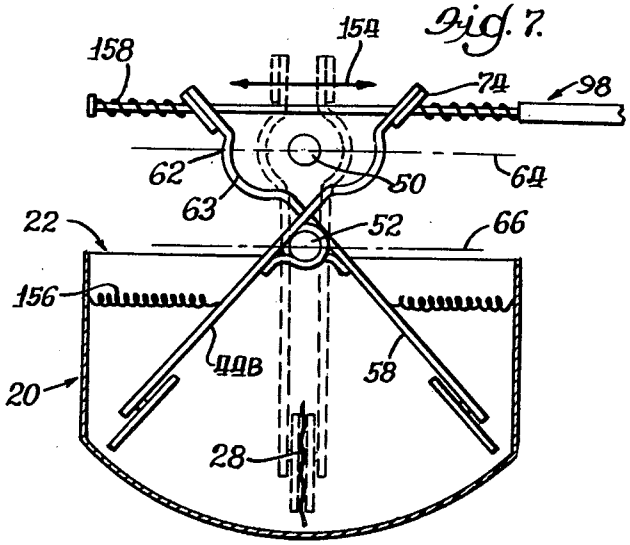
FIG. 7 is a sectional view taken at line 7—7 of FIG. 1.

In the group 44B, each gripper plate 48 is mounted on an arm 58, the two arms of each pair being pivotally mounted on the lower shaft 52 in a bearing assembly 60 which may be similar to the assembly 56. In the present instance the arms 58 have extensions 62 extending above the shaft 52 for purpose to be referred to hereinbelow, the extensions having bowed portions 63 for accommodating the upper shaft 50. The bearing assemblies 50 permit free swinging movement of the arms 58 toward and from each other, this movement being represented by the solid and dotted lines in FIG. 7.

In the case of all the grippers 44, these are permitted limited swinging movement in the respective bearing assemblies 56, 60 about transverse axes 64, 66 extending through the respective shafts (see FIGS. 6, 7) for moving the goods longitudinally through the tank as described hereinbelow.

Secured to all of the grippers for actuating them in synchronized relation for moving the goods longitudinally through the tank are four actuating bars: a first pair 68, 70 secured to the grippers 44A of the one group, each bar being connected to corresponding ones of all the pairs; similarly bars 72, 74 are secured to the grippers of the groups 44B, each one of these two bars being secured to corresponding ones of all the pairs of that group. These bars, 68, 70, 72, 74 function in moving the gripper members both in gripping action and in the action of moving the goods through the tank.

Figure 2:
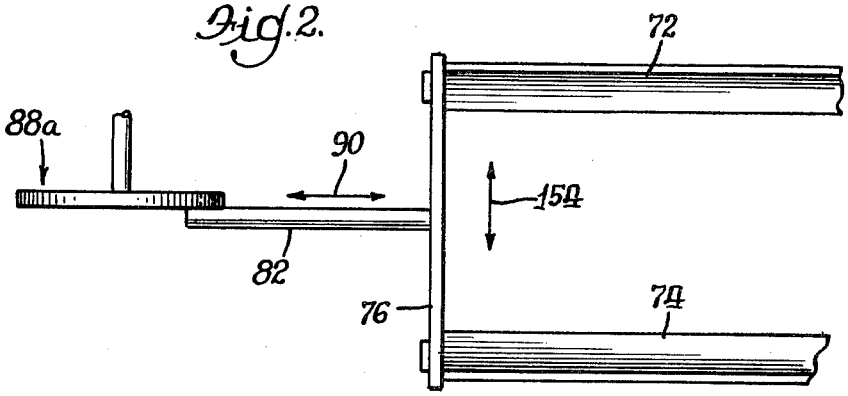
FIG. 2 is a view oriented according to line 2—2 of FIG. 1.
Figure 3:
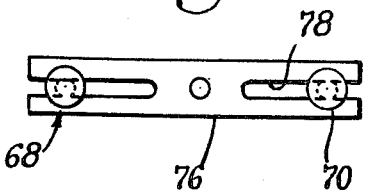
FIG. 3 is a view taken at line 3—3 of FIG. 1.

Each pair of bars 68, 70 and 72, 74 are interconnected by a cross plate 76 (FIGS. 1, 2, 3) having open ended slots 78 in its ends receiving pins 80 on the ends of the bars. A cam assembly 87 is provided, including a pair of cam units 88, individually identified **88*a*, 88*b*. A common connecting rod 82 has a cam follower 84 operatively engaged in a cam groove 86 in one of the cam units, e.g. 88*a*, and the latter, upon rotation thereof, and acting through the connecting rod 82, moves the bars 72, 74 longitudinally of the tank, that is, to the left and right of FIG. 1 as indicated by the double headed arrow 90. The slots 78 (FIG. 3) accommodate movement of the bars toward and from each other in the gripping action described hereinbelow. A similar arrangement is provided for actuating the bars 68, 70 which are driven by the cam unit 88*b***. The mechanism for driving these two sets of bars are identical except for individual adjustment as will be described hereinbelow.

FIG. 4 shows the means for actuating the grippers toward and from each other in the gripping action. Connected with the bars 68, 70 is a bowden wire member 92 having a sleeve element 94 connected with the near bar 70 and a wire 96 within the sleeve and extending therebeyond connected with the far bar 68. A similar arrangement includes a bowden wire 98 having sleeve 100 connected with the near bar 74 and a wire 102 within the sleeve and extending therebeyond and connected with the far bar 72.

Figure 5:
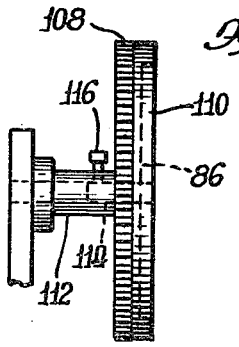
FIG. 5 is a large scale detail view of one of the driving cams of FIG. 4.

Provided for actuating the bars toward and from each other, in FIG. 4, is a cam assembly 104 which is similar to the cam assembly 87. Incorporated in this assembly 104 are cam units 106 individually identified as **106*a*, 106*b*, 106*c*, 106*d*. These cam units, as well as the cam units 88, may be constructed as shown in FIG. 5, each including a base plate 108 and a cam plate 110, the base plate having a shaft 112 in the form a sleeve for supporting it, and the cam plate 110 having a shaft 114 extending into a bore in the shaft 112 and secured therein as by a set screw 116, this set screw enabling adjustment of the cam plate 110 rotatably thereon, and securement of the latter in adjusted position. Each cam plate 110 has a nonconcentric cam groove 86 for receiving the cam follower 84, both identified above, and corresponding ones of other cam followers in the construction of FIG. 4**, as described hereinbelow.

The cam units 106 are mounted in a common bracket 120 and are driven by driving elements 122 of suitable kind which may be in the form of gears as herein shown, meshing with teeth 124 on the exterior of the base plates 108, for driving the latter in unison. The gears 122 are mounted on a shaft 126 driven by a suitable motor 128 operating through a variable speed gearing 130 of known kind of adjustably varying the speed of drive of the gears 122.

Mounted on the shaft 126 is a miter gear 132 meshing with another miter gear 134 on a shaft 136, this shaft being supported in a bracket 138. On the shaft 136 are gears 140 driving the cam units **88*a*, 88*b*, identified above. In this case also the cam plates 108 of the units 88*a*, 88*b*, may be provided with teeth 142 for meshing with the gears 140 for driving them in unison. The assembly 87 in FIG. 4 includes details of construction not included in FIG. 1**, the latter being diagrammatic in this respect.

Operatively connected with the cam units **106*a*, 106*b*, are brackets 144 respectively provided with cam followers 146 following in cam grooves 86 (FIGS. 1 and 5) in those cam units and these brackets 144 are respectively connected with the bowden wire elements 92, 96. Similarly operatively connected with the cam units 106*c*, 106*d* are brackets 148 having cam followers 150 in cam grooves 86 in those cam units, and these brackets 148 are respectively connected with the elements 100, 102 of the bowden wire 98. Upon rotation of the cam units 106, the brackets 144 in the one case are moved in mutually opposite directions as indicated by the arrows 152 and similarly the brackets 148 are moved in mutually opposite directions as indicated by arrows 154. These brackets operating through the bowden wires 92, 98 and through the bars 68, 70, 72, 74, swing the grippers toward and from each other. This action is represented by the full line and dotted line positions of those grippers in FIGS. 6 and 7. The grippers 44A of the one group are operated in unison and similarly the grippers 44B** of the other group are operated in unison, but the two are operated oppositely so that when those of one group are released, those of the other group are in gripping position.

Upon operation of the motor 128, and rotation of the shaft 136, the cam units **88*a*, 88*b* are rotated, and the latter acting through the connecting rods 82, move the bars 68, 70, 72, 74 longitudinally of the washer, as indicated by the arrows 90**.

The operation of gripping and moving the goods through the washer then is that as one group of grippers grip the goods, they are swung forwardly, i.e., counterclockwise as viewed in FIG. 1, through the action of one of the cam units **88*a*, 88*b*. As the other grippers are released, they are swung in the opposite direction, clockwise as viewed in FIG. 1**, and therefore as each group of grippers grip the goods they move them forwardly or longitudinally in the tank.

It may be desired to bias the grippers toward each other by compression springs 156 (FIGS. 6 and 7) and also it may be desired to utilize compression springs 158 between the respective sleeves and inner wires in the bowden wires and the grippers to absorb any inaccuracies or shock.

The resilient compression springs 158 provide a great advantage in accommodating masses of goods of different thicknesses. If a load that is light in weight is being washed, the grippers would be moved relatively closer together in gripping that load, but on the other hand if a heavy load is being washed, it will be a greater mass and consequently thicker, and accordingly the springs 158 will yield as the gripper plates engage the goods at relatively greater spacing apart.

This is a decided advantage of the invention in that goods can be washed in the apparatus regardless of the weight of the load, within wide limits, and it is not necessary to adjust the apparatus for any given size load. Moreover the load may proceed in "globs", being heavy and light alternately, in relatively short distances, and the apparatus will accommodate such situation automatically.

The extent of movement of the grippers may be varied through adjustment of the various cam units. For example, the throw of the grippers longitudinally of the washer as indicated by the arrows 90 is provided by the variation of radial distances of the points of the cam groove 86. This may be provided by providing individual and interchangeable cam plates 110. At the lower portion of FIG. 1 the dot-dash line position of the grippers indicates a representative amount of throw of the grippers, but this may be greater or lesser depending upon how fast it is desired to have the goods move through the washer. On the other hand it may be desired to have greater agitation, and in that case, different cam plates 110 in the cam units 106 may be provided to correspondingly produce greater throw of the grippers toward and from each other as viewed in FIGS. 6 and 7. For example if it is desired to have the goods agitated a greater amount but passing through the washer at a slower rate, the cam units 88*a*, 88*b*, may be adjusted for a small throw so as to feed the goods slowly and the cam units 106 adjust for a greater throw for greater agitation. In either case the variable speed gearing 130 may be adjusted for faster or slower action in the washer.

It may be desired, and usually will be desired, for there to be a pause or dwell of the grippers in moving toward each other, before they are released. That is, it will be desired to have the grippers of the opposite group in gripping position before the first group are released, and this action will of course be accommodated by the position of the desired shape of cam plates 110.

The gripper plates 48 as indicated above are shown as of open work construction. Alternatively, it may be desired that less total open area be provided than as indicated, and it also may be desired to have more opening on one of a pair of gripper plates than the other so as to utilize the one for forcing more water through the open area of the other.

As the goods or towels 28 are dropped into the inlet end, they work down through the restricted opening 40 and are gripped by the first pair of grippers 44[1], and drawn forwardly and then gripped by the next pair, and successively by all of the pairs in the washer. The number of grippers may be as desired. Generally speaking the greater the number of grippers there are, the greater will be the washing action, but it is also possible to vary the washing action for any given number of grippers such as referred to above so that the arrangement enables a maximum amount of agitating action for any given length of apparatus and therefore great efficiency is realized in requiring only a minimum length of apparatus, resulting in corresponding economy.

The goods are gripped a plurality of times, at each of a plurality of increments therealong, as the goods move through the water, and each time they are gripped, they are agitated, and that agitation is of positive nature.

Washing apparatuses or units of the kind represented in FIG. 1 may be arranged in serial order, so that the goods being laundered may proceed from one unit to the next, one for washing, one for rinsing, etc., and each unit can be individually adjusted without requiring adjustment of others. For example, if a certain kind of goods require vigorous agitation for washing, the unit performing the washing action may be adjusted for greater agitation, and a following unit arranged for rinsing may be adjusted for less agitation, the rinsing usually requiring such less agitation, and accordingly a plurality of such units can be arranged in serial order for operating in a continuous line of laundering operations, each unit performing differently, and without interrupting the general progress of the goods through the successive units or chain of aparatus.

The action of the grippers is such as to cause a minimum of splashing. Since these grippers move essentially toward and from each other, as distinguished from rotary agitators, the splashing of the water is done principally in transverse directions as opposed to vertically, and as a consequence a minimum of water will be splashed out through the open top. An advantage of this is of course that the internal mechanism is readily accessible, and there has never been so far as is known, a successful commercial washing machine in the industrial field having an open top.

While the cam units 106, 88 may be driven by individual motors, it is desired to have a single common motor 128 (FIG. 4) so as to assure synchronized movement between the various grippers and produce coordinated action.

I claim:

1. A method of laundering goods comprising the steps, placing the goods in a body of washing water, gripping the goods, while they are immersed in the washing water, by grippers on opposite sides of the goods which interact to so grip the goods therebetween, and in such manner that the gripping action is positive whereby the grippers hold the goods against free movement, so gripping them that the gripping action produces agitation thereof, so gripping them in repeated manner in alternate gripping and releasing steps and moving them by the grippers bodily through the washing water while they are gripped, and removing them from the washing water in conjunction with a final releasing step.

2. A method according to claim 1 wherein, the grippers are operative for supporting the goods independently of all other means, whereby the gripping action and consequent agitation, and the moving action, are determined solely by the action of the grippers in the course of the movement of the goods through the water.

3. A method according to claim 2 and including, utilizing a plurality of pairs of grippers, and maintaining a gripping action by first pairs of grippers while second pairs are released, and alternating the action of the first and second pairs, whereby the goods are held in gripped position by at least certain of the grippers, and supported thereby, at all times.

4. A method according to claim 2 wherein, the grippers, due to their functioning as the sole means for supporting the goods and moving them bodily through the water, are operable for agitating them repeatedly throughout their bodily movement through the water.

5. A method according to claim 1 and including, moving the goods through the washing water in a first direction, and flowing the washing water in the opposite direction.

6. A method according to claim 1 and including, providing laundering water in a plurality of containers along a line, placing the goods in a first of the containers for movement bodily longitudinally through the containers successively, performing the gripping and consequent agitating steps, and moving the goods bodily through the water, in each of the containers as stated, and so moving them bodily at a substantially uniform rate through the plurality of containers, and agitating the goods in certain of the containers at a rate different from that in others of the containers, while maintaining the rate of longitudinal bodily movement through the containers substantially uniform.

7. A method according to claim 6 wherein, the agitating action of different rates is produced by the grippers in their gripping action at different rates relative to their action in moving the goods bodily longitudinally.

8. A method according to claim 6 and including, utilizing washing water of relatively different washing and rinsing characteristics respectfully in the containers, wherein the gripping and consequent agitating action are respectively greater and lesser.

* * * * *